US006022039A

United States Patent [19]

Chevalier

[11] Patent Number: 6,022,039

[45] **Date of Patent: *Feb. 8, 2000**

[54] SKI BINDING EQUIPPED WITH A DETACHABLE BRAKE

[75] Inventor: Jean-Louis Chevalier, Nevers, France

[73] Assignee: Look Fixations S.A., Nevers, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/748,555

[22] Filed: Nov. 8, 1996

[30] Foreign Application Priority Data

Nov. 21, 1995 [FR] France ..... 95 14047

[51] Int. Cl.[7] ..... A63C 7/00

[52] U.S. Cl. ..... 280/605

[58] Field of Search ..... 280/604, 605, 280/607, 633, 611

[56] References Cited

U.S. PATENT DOCUMENTS

| | | | |
|---|---|---|---|
| 4,366,968 | 1/1983 | Klubitschko | 280/605 |
| 4,524,990 | 6/1985 | Svoboda et al. | 280/633 |
| 4,813,700 | 3/1989 | Riegler et al. | 280/633 |
| 5,002,303 | 3/1991 | Freisinger et al. . | |
| 5,042,829 | 8/1991 | Sedlmair | 280/633 |
| 5,242,188 | 9/1993 | Bigler et al. | 280/607 |
| 5,362,086 | 11/1994 | Baron et al. | 280/605 |

FOREIGN PATENT DOCUMENTS

| | | |
|---|---|---|
| 576 874 | 1/1994 | European Pat. Off. . |
| 2 208692 | 6/1974 | France . |
| 2 640 152 | 6/1990 | France . |
| 2 668 941 | 5/1992 | France . |

*Primary Examiner*—Paul N. Dickson
*Assistant Examiner*—Avraham H. Lerner
*Attorney, Agent, or Firm*—Bunion S. A.; John Moetteli

[57] ABSTRACT

The binding comprises a baseplate (1) intended to be fixed to the ski by screws (8). This is fitted with a detachable brake (6), mounted on the baseplate by a base (5) held on the baseplate by hooking (16, 17) and by a rotary assembly element. In the region of the brake base (5), the screws (8) for securing the baseplate (1) to the ski bear exclusively on the baseplate, and the base (5) has openings (12) making it possible to access the screws (8) using a screwdriver. The ski binding may be sold fully preequipped, and it can be mounted very quickly on a ski without it being necessary to remove the brake beforehand. When sharpening the edges, the brake can be removed without compromising the securing of the binding to the ski.

1 Claim, 3 Drawing Sheets

SKI BINDING EQUIPPED WITH A DETACHABLE BRAKE

FIELD OF THE INVENTION

The invention relates to an alpine ski binding comprising a baseplate having holes for the passage of screws for securing the baseplate to a ski, said screws bearing exclusively on the baseplate, a boot retention device and a detachable ski brake comprising a base, assembled with the baseplate by at least one rotary assembly element, and at least one brake arm, being mounted on this baseplate.

PRIOR ART

A binding of this type is known from Patent U.S. Pat. No. 5,002,303. Since the screws for securing the plate to the ski do not bear on the base of the brake, the brake can be detached without unscrewing these securing screws, for example in order to resharpen the edges of the ski on a machine, because the brake arms hinder this operation. If the binding is delivered with its brake preassembled it is, however, necessary to remove the brake in order to be able to mount the binding on the ski, because the base of the brake covers the fastening screws. This is also the case with the binding described in Patent FR No. 2 668 941.

Furthermore, Patent FR No. 2 692 804 discloses a binding in which the brake base may also be temporarily preassembled with the baseplate of the binding using a screw, so that the binding can be delivered fully assembled to the retailers. The binding is mounted on the ski using screws, two of which pass through the brake base and bear on this brake base. The preassembled binding can therefore be mounted very quickly, but the ski brake is removed by unscrewing, on the one hand, the screw securing it to the baseplate and, on the other hand, the two screws for securing the binding to the ski. However, the effect of repeatedly unscrewing and rescrewing the screws for securing the binding to the ski is to enlarge the screw thread formed in the nonmetallic material of the ski during the first screwing operation, so that the screws acquire play and no longer securely hold the binding to the ski.

A binding LOOK N77 is furthermore known, in which the base of the ski brake is fixed by clamping or hooking under the toe stop, between the stop and the ski. This solution allows the ski brake to be mounted very quickly, but the binding cannot be delivered preassembled to the retailer, and removal of the brake requires untightening of the screws holding the stop to the ski.

SUMMARY OF THE INVENTION

The object of the present invention is to produce a binding which can be delivered to the retailer fully assembled, that is to say with the ski brake assembled with the baseplate of the binding element, and which also makes it possible, after the binding is mounted on the ski, to remove the ski brake with ease without touching the screws holding the binding on the ski.

To this end, the ski binding according to the invention is one wherein the base of the detachable brake has access openings to the screws for securing the baseplate to the ski, allowing the passage of a tightening tool for accessing said screws so that it is possible to screw the baseplate/brake assembly onto the ski with the brake prefitted.

In the case when said openings are holes, they may, after the binding is mounted on the ski, be closed off by plugs, with the brake base thus covering the screws of the baseplate.

The brake base may be assembled with the baseplate by two or more rotary fastening elements, but it is preferably held to the baseplate, on the one hand, by hooking and, on the other hand, by a single rotary assembly element.

The rotary assembly element may be a screw or a cylindrical quarter-turn assembly stud, or any similar element. This element may be locked by an end-of-travel catch.

Such a binding is generally fitted with an elastomer sole placed under the baseplate. This sole may advantageously be used for holding the baseplate securing screws to the ski before the binding is mounted on a ski.

The ski brake can thus be detached and remounted without compromising the holding of the binding to the ski.

BRIEF DESCRIPTION OF THE DRAWINGS

The appended drawing represents, by way of example, one embodiment of the invention.

DESCRIPTION OF THE PREFERRED EMBODIMENT

Figure 1:
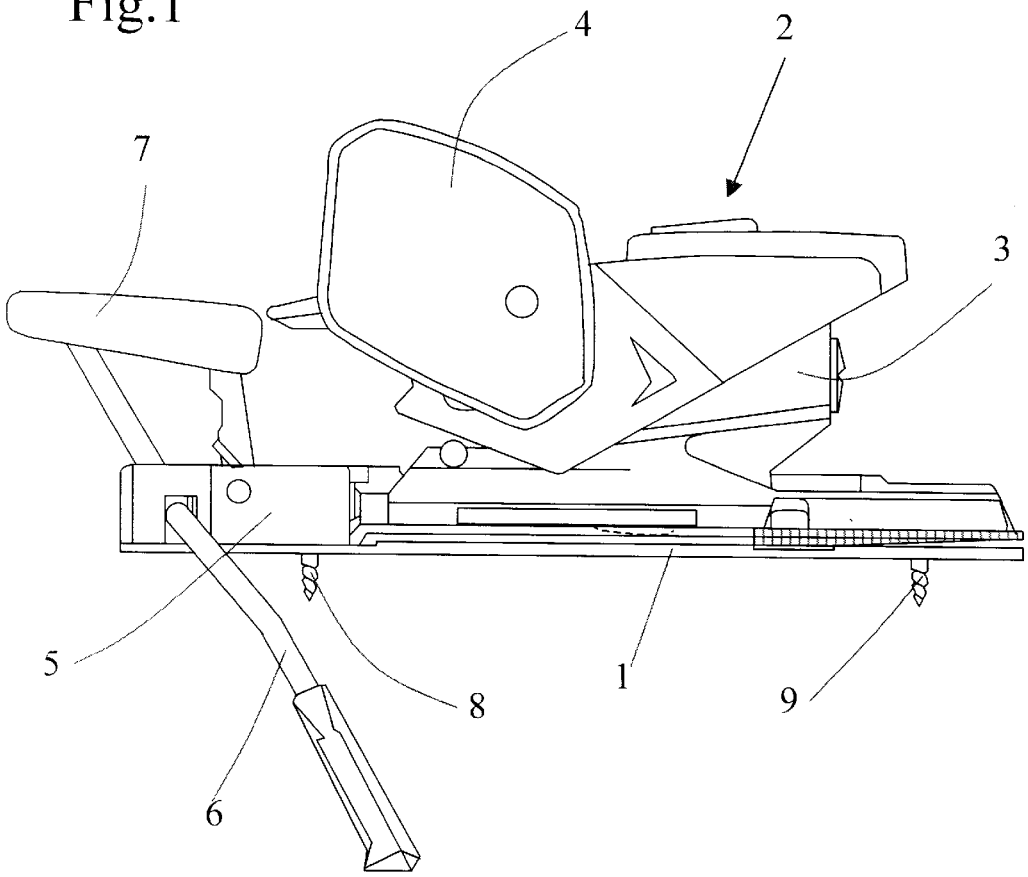
FIG. 1 is a side elevation of a rear binding equipped with its brake, as delivered to the retailers.
Figure 2:
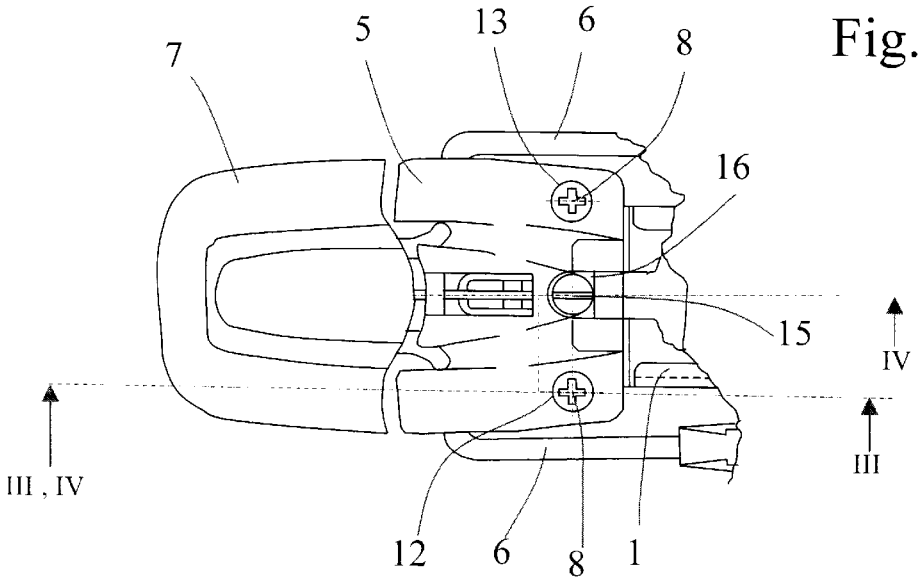
FIG. 2 is a partial plan of the brake part in FIG. 1.

The binding represented in FIG. 1 is as it is delivered assembled to the retailers. This binding consists of a baseplate 1 on which the following are mounted: on the one hand, a heel piece 2 consisting of a body 3 whose position on the baseplate 1 can be adjusted and which is fitted with a jaw 4 intended to hold the heel of a boot and, on the other hand, a ski brake consisting of two brake arms 6 which are articulated on a brake base 5 and are fitted with a pedal 7 which raises the brake arms 6 against the action of a spring when a boot is fitted into the binding. The binding is furthermore fitted with at least two pairs of screws 8 and 9 for securing it to the ski.

Figure 3:
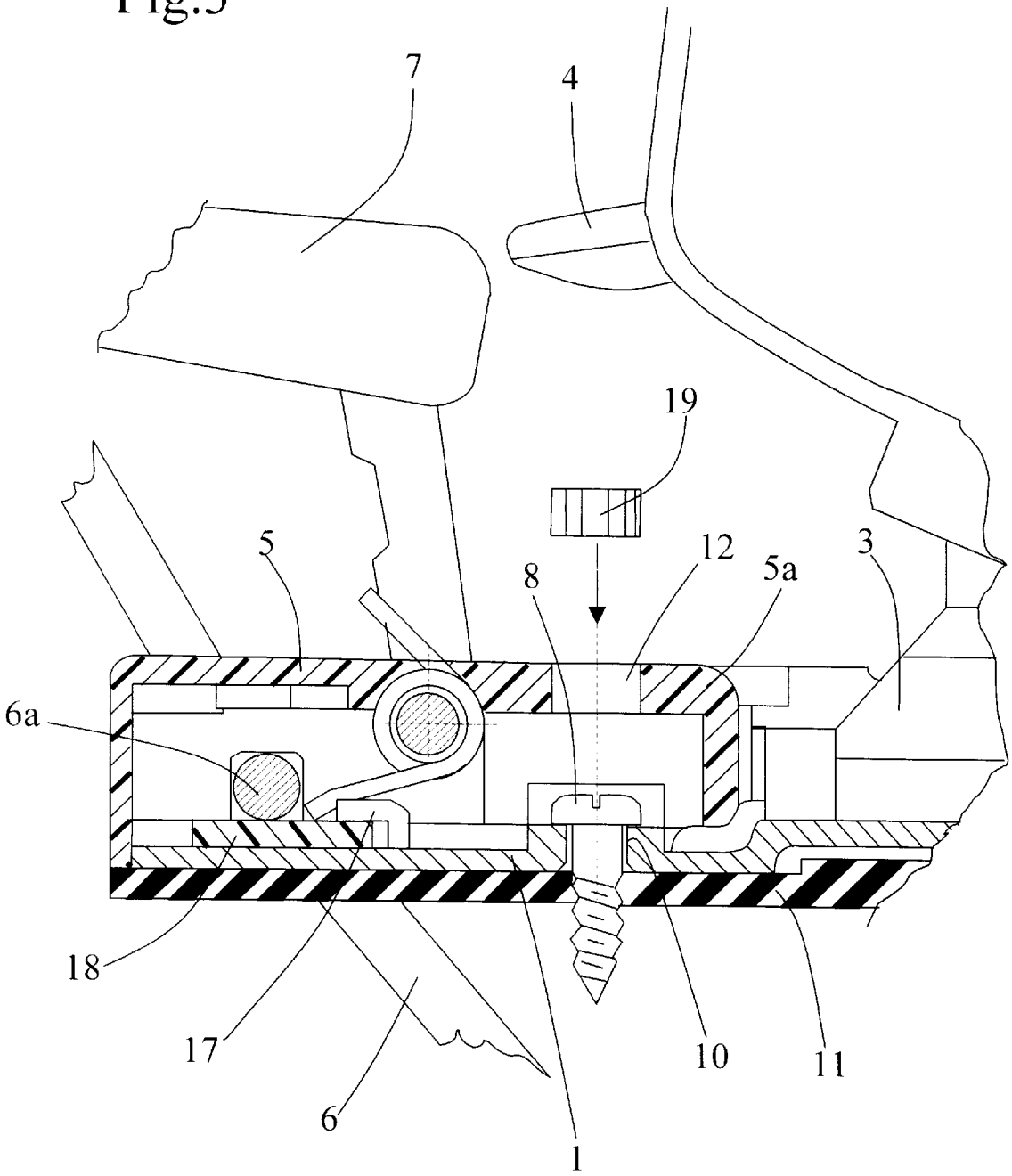
FIG. 3 is a section on III—III of the part represented in FIG. 2.

Under the brake base 5, the steel baseplate 1 has two holes 10, one on each side of its longitudinal axis, which holes are formed by cutting and stamping (FIG. 3). These holes 10 are intended to accommodate the pair of screws 8 whose head bears on the protuberance formed by the stamping. An elastomer sole 11 is adhesively bonded, in a known manner, under the baseplate 1. In this case, this sole 11 is used for holding the screws 8 and 9 in the preassembled position represented in FIG. 1.

The brake base 5 is in the form of a plastic box through which the bent parts 6*a* of the brake arms 6 and the axle for articulating the bar of the pedal 7 onto the base. This base 5 has a part 5*a* forming a cap which covers the baseplate 1 above its holes 10. This part 5*a* has two holes 12 and 13, respectively superposed with each of the screws 8. The diameter of these holes 12 and 13 is sufficient to allow the passage of a screwdriver for screwing the screws 8. These holes 12 and 13 are defined by surfaces (<<defining surfaces>>)30. This diameter is therefore independent of the diameter of the heads of the screws 8. It could therefore be less than the diameter of the heads of the screws 8, so that the screws 8 are also prevented from escaping from the brake base, regardless of whether or not they are held by the sole 11.

On its longitudinal mid-axis, the baseplate 1 also has a socle 14 provided with a threaded hole into which a screw

Figure 4:
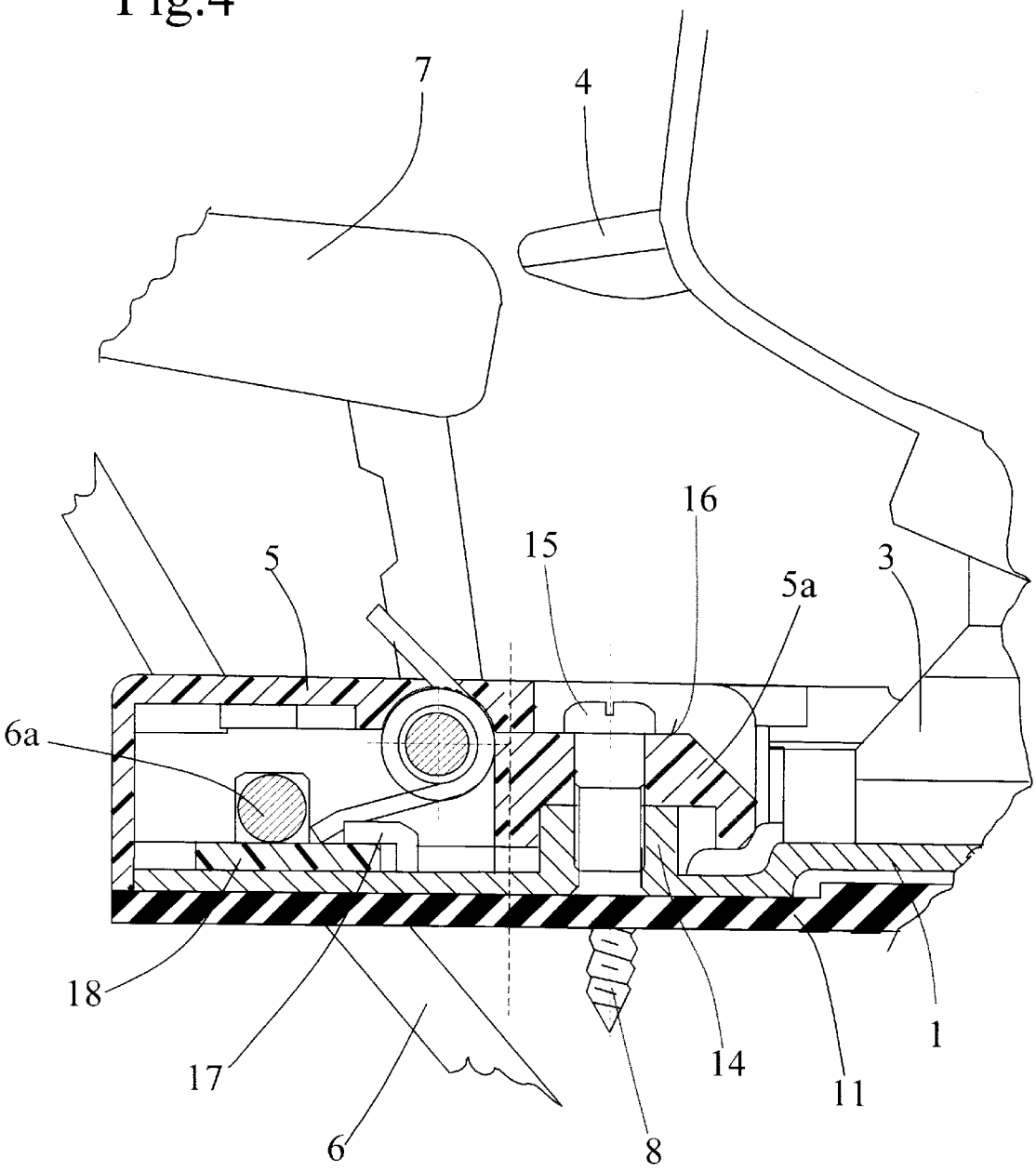
FIG. 4 is a section on IV—IV of the same part represented in FIG. 2.

15 is screwed, the head of which screw bears on the bottom of a countersink 16 formed in the upper face of the brake base 5. The brake base 5 is also held on the baseplate 1 by a pair of lugs 7 which are cut out from the baseplate 1 and have a part approximately parallel to the baseplate 1 and directed toward the end of the baseplate. The brake base 5 is hooked under the lugs 17 by a cross piece 18 (FIG. 4) which is also used to close the housing of the bent parts 6*a* constituting the articulation axles of the brake arms 6 in the brake base.

The brake base can therefore be preassembled with the baseplate 1 by hooking under the lugs 17, then by locking using the screw 15. The binding can then be mounted on a ski. After mounting, it is in principle no longer necessary to have access to the screws 8, so that the holes 12 and 13 may be closed off by plugs 19, which plugs could alternatively have any other form than that represented. The brake can be removed from the binding simply by unscrewing the screw 15.

The hooking by the lugs 17 could be replaced by any other interlocking method or by screws similar to the screw 15, but the hooking method which is represented has the advantage of not hindering the passage of the bent parts of the brake arms 6 in the brake base 5.

The access openings consisting of the holes 12 and 13 could have a different form, for example the form of a notch cut into the rear edge of the brake base.

I claim:

1. An alpine ski binding comprising a baseplate (1) having holes (10), screws (8) which pass through said holes (10), said screws securing the baseplate to a ski and bearing exclusively on the baseplate, a boot retention device (2) and a detachable ski brake comprising a brake base (5) which is spaced apart from the ski when assembled with the baseplate by at least one rotary assembly element (15), and at least one brake arm (6), being mounted on the brake base (5), (a) wherein the brake base (5) of the detachable brake has access openings (12, 13) to the screws (8), the access openings being configured to retain the screws when the screws are loosened from the ski, wherein no surface (30) which defines any access opening (12, 13) is fastened against any corresponding screw (8), for permitting the securing of the baseplate to the ski by allowing the passage of a tightening tool for accessing said screws, so that it is possible to screw the baseplate/brake assembly onto the ski while the brake is rigidly attached to the baseplate by at least the rotary assembly element (15); and (b) wherein removal of at least the rotary assembly element (15) permits the removal of the brake base (5) from the baseplate without requiring removal of any of the screws (8) which fix the baseplate to the ski.

* * * * *